US008895827B1

(12) United States Patent
Grossman

(10) Patent No.: US 8,895,827 B1
(45) Date of Patent: Nov. 25, 2014

(54) PERCUSSION INSTRUMENT DAMPENING PAD

(71) Applicant: Richard D. Grossman, West Hills, CA (US)

(72) Inventor: Richard D. Grossman, West Hills, CA (US)

( * ) Notice: Subject to any disclaimer, the term of this patent is extended or adjusted under 35 U.S.C. 154(b) by 0 days.

(21) Appl. No.: 13/917,401

(22) Filed: Jun. 13, 2013

(51) Int. Cl.
*G10D 13/02* (2006.01)

(52) U.S. Cl.
CPC ..... *G10D 13/02* (2013.01); *G10D 13/022* (2013.01)
USPC ..... 84/411 M

(58) Field of Classification Search
CPC ..... G10D 13/022
See application file for complete search history.

(56) References Cited

U.S. PATENT DOCUMENTS

| | | | | | |
|---|---|---|---|---|---|
| 2,565,225 | A | * | 8/1951 | Gladstone | 84/411 R |
| 4,154,137 | A | | 5/1979 | Kobayashi | |
| 4,179,974 | A | * | 12/1979 | Trankle | 84/411 P |
| 4,244,266 | A | * | 1/1981 | Hardy | 84/411 M |
| 4,325,280 | A | * | 4/1982 | Hardy | 84/411 M |
| 4,567,807 | A | * | 2/1986 | Robinson | 84/411 M |
| 4,581,973 | A | | 4/1986 | Hoshino | |
| 4,745,839 | A | | 5/1988 | Peraino | |
| 4,776,254 | A | | 10/1988 | Cruz | |
| 4,805,514 | A | * | 2/1989 | Billings | 84/411 M |
| 4,899,635 | A | * | 2/1990 | Santangelo | 84/411 M |
| 5,561,254 | A | * | 10/1996 | Huffer | 84/411 M |
| 5,637,819 | A | | 6/1997 | Rogers | |
| 5,877,440 | A | * | 3/1999 | Chaffee et al. | 84/411 M |
| 5,892,168 | A | * | 4/1999 | Donohoe | 84/411 M |
| 5,892,169 | A | * | 4/1999 | Shapiro | 84/411 M |
| 6,291,754 | B1 | * | 9/2001 | Gatzen et al. | 84/411 M |
| 6,307,133 | B1 | * | 10/2001 | May et al. | 84/411 M |
| 6,365,812 | B1 | * | 4/2002 | McGill | 84/414 |
| 8,541,675 | B2 | * | 9/2013 | Strickland | 84/411 M |
| 2005/0109190 | A1 | * | 5/2005 | Smith et al. | 84/414 |
| 2005/0200059 | A1 | * | 9/2005 | Smith et al. | 267/140.3 |
| 2006/0065099 | A1 | * | 3/2006 | Anderson | 84/411 M |
| 2007/0022863 | A1 | * | 2/2007 | Ross | 84/411 M |
| 2007/0056428 | A1 | * | 3/2007 | May, Jr. | 84/41 |
| 2007/0068364 | A1 | * | 3/2007 | Sharp | 84/411 R |

* cited by examiner

*Primary Examiner* — Robert W Horn
(74) *Attorney, Agent, or Firm* — Albert O. Cota

(57) ABSTRACT

A percussion instrument dampening pad (PIDP) that is designed to be attached to the vibrating surface of a drumhead, a drum, a cymbal or the like. The PIDP functions by reducing unwanted vibrations and overtones that occur when the drumhead or cymbal is struck. The PIDP is comprised of at least one composite upper section, a first vibration absorbent layer preferably comprised of polyurethane puron foam, and a second vibration absorbent layer preferably comprised of butyl rubber that is in contact with the vibrating surface of the drumhead, drum or the cymbal. The composite upper section is further comprised of a metallized layer, a fabric layer and an adhesive layer. The PIDP also includes indicia and a removable liner that is removed prior to attaching the exposed butyl rubber to the surface of a drumhead or the like.

18 Claims, 2 Drawing Sheets

PERCUSSION INSTRUMENT DAMPENING PAD

TECHNICAL FIELD

The invention generally pertains to devices that reduce unwanted vibrations and overtones that result when a drumhead or the like is struck, and more particularly to a multi-layered pad that is easily and selectively attached to a drumhead to reduce the unwanted vibrations and overtones.

BACKGROUND ART

Percussionists often want to dampen drumheads, drums, cymbals and the like to reduce unwanted vibrations commonly referred to as overtones that occur when a drumhead is struck. Various devices have been made to reduce the undesirable effect of excessive drumhead vibrations and overtones. The most widely used device is a patch containing a gel-like material having natural adhesive characteristics. This device does dampen vibrations and overtones but has a very short useful life due to its characteristics which attract foreign matter to its upper surface, causing the device to appear dirty and unsightly.

The prior art gel-like materials also have a low strength which is detrimental when removing and reapplying the device to new locations on a percussion vibration surface. The gel-like material loses its adhesive qualities as it becomes contaminated by both airborne particles and handling related contamination. This requires washing of the patch which is undesirable to the user. The patch is also sensitive to temperature. Therefore, stage lighting can reduce the resilient substance within the patch to a near liquid state which is then difficult to remove from the drumhead surface.

A search of the prior art did not disclose any publications or patents that read directly on the claims of the instant invention. However, the following U.S. patents are considered related:

| Pat.No. | INVENTOR | ISSUED |
|---|---|---|
| 5,877,440 | Chaffee | 5 Mar. 1999 |
| 4,776,254 | Cruz | 11 Oct. 1988 |
| 4,581,973 | Hoshino | 15 Apr. 1986 |
| 4,154,137 | Kobayashi | 15 May 1979 |
| 2005/0200059 | Smith | 15 Sep. 2005 |

The U.S. Pat. No. 5,637,819 discloses a damped percussion instrument having a vibrating surface. A dampening gel patch is attached to the surface to remove unwanted vibrations and overtones.

The U.S. Pat. No. 4,745,839 discloses a drum-mute device used to dampen a drumhead and remove unwanted overtones. The drum-mute device is installed on the inside of the drum in contact with the drum skin and is supported in position by a mounting rod having its ends spanning the drum body. The drum-mute device is comprised of either an inflatable member or a resilient foam member.

The US 2007/0068364 publication discloses a system and method for damping a vibrating surface, such as a drumhead of a percussion instrument. The damping is provided by attaching a patch made from a viscoelastic urethane polymer to an exterior face of the vibrating surface. The patch has a self-adhesive quality and is attached by contacting the vibrating surface.

For background purposes and indicative of the art to which the invention relates, reference may be made to the following remaining patents found in the patent search.

| Pat. No. | INVENTOR | ISSUED |
|---|---|---|
| 4,776,254 | Cruz | 11 Oct. 1988 |
| 4,581,973 | Hoshino | 15 Apr. 1986 |
| 4,154,137 | Kobayashi | 15 May 1979 |

DISCLOSURE OF THE INVENTION

The percussion instrument dampening pad, (PIDP) which also referred to as a TONE COOKIE™, is comprised of an integral unit having three major elements: a composite upper section, a first vibration absorbent layer, and a second vibrator absorbent layer. The composite upper section is further comprised of an upper metallized layer, a fabric layer and an adhesive layer. The PIDP is designed to be attached to a user selectable area of a percussion instrument. When the percussion instrument is struck, unwanted vibration and overtones are significantly reduced.

In view of the above disclosure, the primary object of the invention is to produce a PIDP that is easily made and applied to a drumhead to reduce unwanted vibrations and overtones that occur when a percussion instrument is struck.

In addition to the primary object of the invention it is also an object of the invention to produce a PIDP that:

- has an upper surface that does not attract foreign matter,
- is easily attached to a drumhead and when necessary is also easily removed,
- has a high heat threshold,
- can be produced in various shapes,
- is reusable, and
- is cost effective from both a manufacturer's and consumer's point of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

The best mode for carrying out the invention is presented in terms that disclose a preferred embodiment of a percussion instrument dampening pad (PIDP) that is designed to be attached to a drumhead, a drum, a cymbal or the like to reduce unwanted vibrations and overtones. The preferred embodiment of the PIDP 10, as shown in FIGS. 1-6, is comprised of three major elements: at least one composite upper section 12, a first vibration absorbent layer 32, and a second vibration absorbent layer 40. The PIDP 10 can also be comprised of only the first and the second vibration absorbent layers 32,40.

Figure 2:
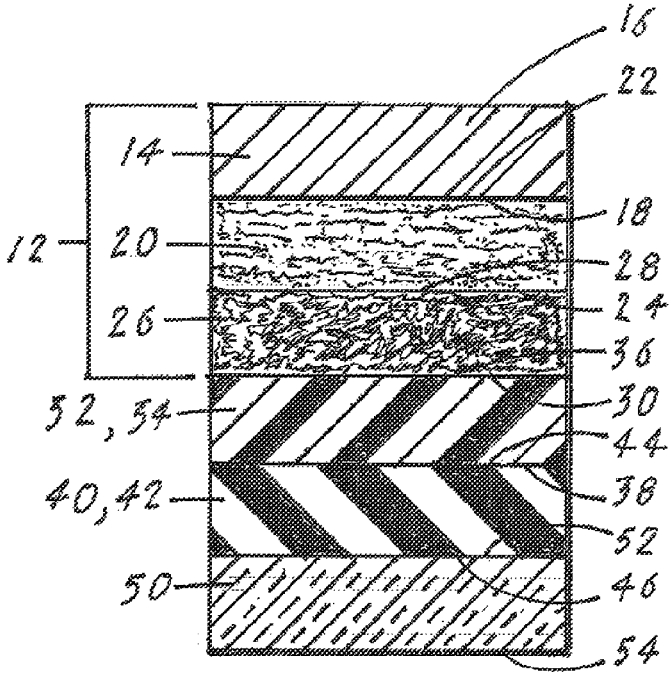
FIG. 2 is a sectional elevational view showing the elements that comprise the PIDP.

The at least one composite upper section 12, as shown in FIG. 2, is further comprised of a metallized layer 14, a fabric layer 20 and an adhesive layer 26. The three layers 14,20 and 26 are procured as a single element. The metallized layer 14 can consist of aluminum, copper, brass and stainless steel.

The layer 14 has an upper surface 16 and a lower surface 18. Likewise, the fabric layer 20 also has an upper surface 22 and a lower surface 24. The upper surface 22 is integrally attached to the lower surface 18 of the metallized layer 14. The final element that comprises the composite upper section 12 is the adhesive layer 26 which is preferably comprised of a contact adhesive. The adhesive layer 26 has an upper surface 28 and a lower surface 30, with the upper surface 28 applied to the lower surface 24 of the fabric layer 20.

The first vibration absorbent layer 32, as shown in FIG. 2, is preferably comprised of polyurethane and preferably of a polyurethane puron foam 34. The foam 34 has an upper surface 36 and a lower surface 38, with the upper surface 36 attached to the lower surface 38 of the adhesive layer 26.

Figure 1:
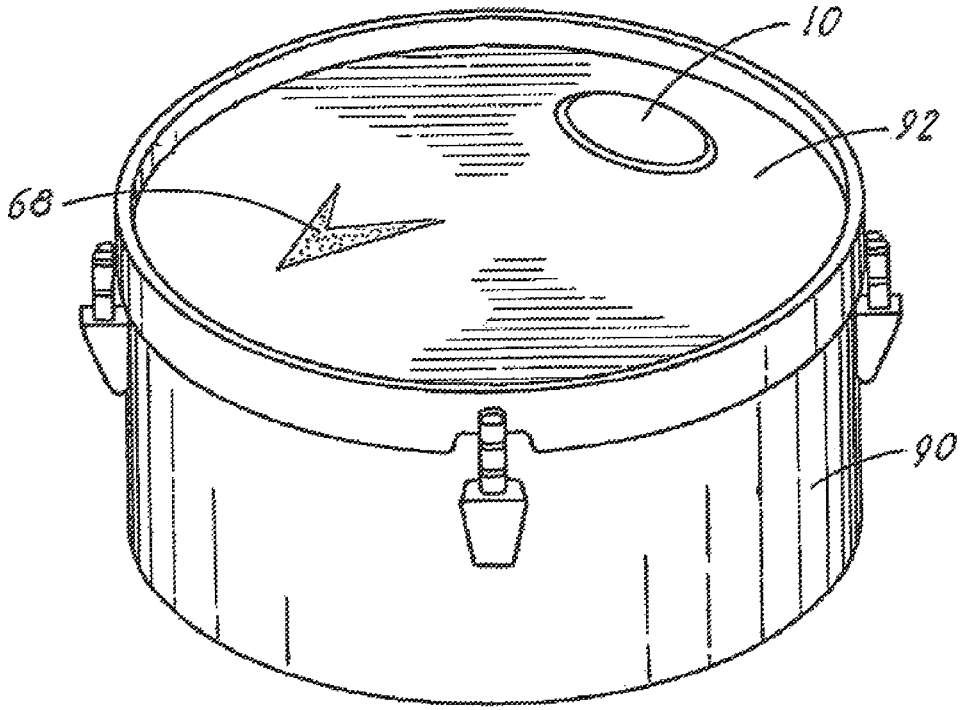
FIG. 1 is an orthographic upper view of a drum having a percussion instrument dampening pad (PIDP) attached to a side of the drumhead.

The second vibration absorbent layer 40, as also shown in FIG. 2, is preferably comprised of butyl rubber 42 that provides adhesive like properties. The butyl rubber 42 has an upper surface 44 and a lower surface 46, with the upper surface 44 attached to the lower surface. 38 of the first vibration absorbent layer 32. The lower surface 46 is attached to a selected area on the drumhead 92 of the percussion instrument 90, as shown in FIG. 1.

The final element that comprises the PIDP 10 is a removable liner 50 that includes an upper surface 52 and a lower surface 54, as shown in FIG. 2. The upper surface is temporarily attached to the lower surface 46 of the second vibration absorbent layer 40. The liner 50 is removed prior to attaching the PIDP 10 to the percussion instrument 90. The removable liner 50 can be attached to each individual PIDP 10 or the liner 50 can consist of a large piece of liner 50 to which is attached a plurality of PIDPs.

Figure 3:
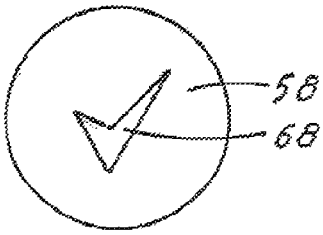
FIG. 3 is a top plan view of a PIDP having a circular shape.
Figure 4:
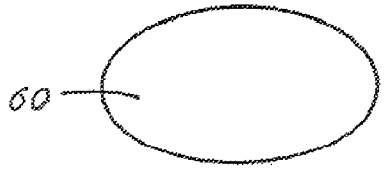
FIG. 4 is a top plan view of a PIDP having an oval shape.
Figure 5:
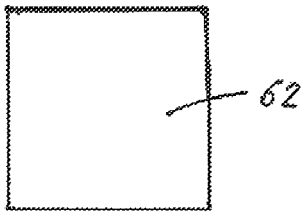
FIG. 5 is a top plan view of a PIDP having a square shape.
Figure 6:
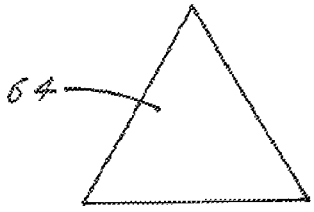
FIG. 6 is a top plan view of a PIDP having a triangular shape.

The PIDP 10 can be configured in a variety of shapes including a circular shape 58, as shown in FIG. 3; an oval shape 60, as shown in FIG. 4; a square shape 62, as shown in FIG. 5; or a triangular shape 64, as shown in FIG. 6. The preferred shape of the PIDP 10 is the oval shape 60. However, a special shape can also be selected by a user by cutting the PIDP 10 to a desired shape.

The circular shape 58 has a diameter ranging from 0.50 to 3.00 inches (1.27 to 7.62 cm) and a thickness ranging from 0.19 to 1.38 inches (0.47 to 3.50 cm).

The oval shape 60 has a vertical length ranging from 0.50 to 3.00 inches (1.27 to 7.62 cm), a horizontal length ranging from 1.0 to 3.0 inches (2.54 to 7.62 cm) and a thickness ranging from 0.19 to 1.38 inches (0.48 to 3.50 cm).

The square shape 62 has sides ranging from 0.50 to 3.00 inches (1.27 to 7.62 cm). The triangular shape also has sides ranging from 0.50 to 3.00 inches (1.27 to 7.62 cm).

The final element that comprises the PIDP 10 is indicia 68 which is applied to the upper surface 16 of the metallized layer 14, as shown in FIG. 3.

While the invention has been described in detail and pictorially shown in the accompanying drawings it is not to be limited to such details, since many changes and modification may be made to the invention without departing from the spirit and the scope thereof. Hence, it is described to cover any and all modifications and forms which may come within the language and scope of the claims.

The invention claimed is:

1. A percussion instrument dampening pad (PIDP) comprising at least one composite upper section further comprising an upper metallized layer, a fabric layer and an adhesive layer, a center section and a lower section, wherein said PIDP is attached to a user-selectable area of a percussion instrument and when the percussion instrument is struck, unwanted vibrations and overtones are reduced.

2. The PIDP as specified in claim 1 wherein the metallized layer is selected from the group consisting of aluminum, copper, brass, and stainless steel.

3. The PIDP as specified in claim 2 wherein the fabric layer is integrally attached to the metallized layer.

4. The PIDP as specified in claim 1 wherein the adhesive is comprised of contact adhesive.

5. The PIDP as specified in claim 1 wherein the center section is comprised of polyurethane puron foam.

6. The PIDP as specified in claim 1 wherein the lower section is comprised of butyl rubber.

7. A percussion instrument dampening pad (PIDP) comprising:

a) at least one composite upper section comprising:
   (1) a metallized layer having an upper surface and a lower surface,
   (2) a fabric layer having an upper surface and a lower surface, wherein the upper surface is integrally attached to the lower surface of the metallized layer,
   (3) an adhesive layer having an upper surface and a lower surface, wherein the upper surface is applied to the lower surface of the fabric layer, b) a first vibration absorbent layer having an upper surface and a lower surface, wherein the upper surface is attached to the lower surface of the adhesive layer, and c) a second vibration absorbent layer, having an upper surface and a lower surface, wherein the upper surface is attached to the lower surface of said first vibration absorbent layer, wherein the lower surface is attached to a selected area of a percussion instrument.

8. The PIDP as specified in claim 7 further comprising a removable liner having an upper surface and a lower surface, wherein the upper surface is attached to the lower surface of said second vibration absorbent layer, wherein said liner is removed prior to attaching said PIDP to the percussion instrument.

9. The PIDP as specified in claim 8 wherein said PIDP has a circular shape having a diameter ranging from 0.50 to 3.00 inches (1.27 to 7.62 cm) and a thickness ranging from 0.19 to 1.38 inches (0.48 to 3.50 cm).

10. The PIDP as Specified in claim 7 wherein said PIDP has an oval shape having a vertical length ranging from 0.50 to 3.00 inches (1.27 to 7.62 cm), a horizontal length ranging from 1.0 to 3.0 inches (2.54 to 7.62 cm) and a thickness ranging from 0.19 to 1.38 inches (0.48 to 3.50 cm).

11. The PIDP as specified in claim 7 wherein said PIDP has a square shape having sides ranging from 0.50 to 3.00 inches (1.27 to 7.62 cm).

12. The PIDP as specified in claim 7 wherein said PIDP has a triangular shape having sides ranging from 0.50 to 3.00/ inches (1.27 to 7.62 cm).

13. The PIDP as specified in claim 7 wherein the metallized layer is comprised of a material selected from the group consisting of aluminum, copper, brass, and stainless steel.

14. The PIDP as specified in claim 13 further comprising indicia that is applied to the upper surface of the metallized layer.

15. The PIDP as specified in claim 7 wherein the adhesive layer is comprised of contact adhesive.

16. The PIDP as specified in claim 7 wherein said first vibration absorbent layer is comprised of polyurethane puron foam.

17. The PIDP as specified in claim 7 wherein said second vibration absorbent layer is comprised of butyl rubber.

18. The PIDP as specified in claim 7 wherein said PIDP is comprised of only said first vibration absorbent layer and said second vibration absorbent layer.

* * * * *